United States Patent [19]

Kohn et al.

[11] 4,149,855

[45] Apr. 17, 1979

[54] STABILIZED COAL-OIL SLURRY AND PROCESS

[75] Inventors: Edward M. Kohn, Philadelphia; William D. Vanderwerff, West Chester, both of Pa.

[73] Assignee: Suntech, Inc., Philadelphia, Pa.

[21] Appl. No.: 913,781

[22] Filed: Jun. 8, 1978

[51] Int. Cl.[2] ..... C10L 1/32

[52] U.S. Cl. ..... 44/51

[58] Field of Search ..... 44/51, 7 A; 252/351

[56] References Cited

U.S. PATENT DOCUMENTS

| | | | |
|---|---|---|---|
| 2,118,477 | 5/1938 | Roberts et al. | 44/51 |
| 2,390,609 | 12/1945 | Minich | 44/7 A |
| 2,397,859 | 4/1946 | Hersberger et al. | 44/51 |
| 2,620,312 | 12/1952 | Manzer | 44/51 |
| 2,763,621 | 9/1956 | Shulman | 44/7 A |
| 2,768,138 | 10/1956 | Hotten et al. | 252/37.7 |
| 3,241,505 | 3/1966 | Long et al. | 44/51 |

*Primary Examiner*—Patrick Garvin
*Assistant Examiner*—Y. Harris-Smith
*Attorney, Agent, or Firm*—J. Edward Hess; Donald R. Johnson; Paul Lipsitz

[57] ABSTRACT

Coal-oil slurries are stabilized by incorporation of a mixture comprised of a hydrogenated coal liquid and a grease made from an aluminum based complex soap.

6 Claims, No Drawings

STABILIZED COAL-OIL SLURRY AND PROCESS

It is known in the art to employ a slurry of comminuted coal in oil as a fuel source. Such slurries have essentially the same handling, burning and heating characteristics as fuel oil but they permit reduced oil consumption by the incorporation of the more readily available coal. However, a problem associated with such coal-oil slurries (COS) is that there is a tendency for the coal particles to settle out. Such instability of the COS creates difficulties in transporting it through pipelines and at the point of use.

Numerous disclosures in the prior art recognize this problem and offer various means to solve it. U.S. Pat. No. 1,647,471 suggests the use of a colloidal solution such as a soap solution or a rubber solution to mitigate the problem. U.S. Pat. No. 1,431,225, U.S. Pat. No. 1,733,620 and U.S. Pat. No. 2,668,757 also disclose use of soaps such as ordinary soap or alkaline earth metal (e.g. calcium and magnesium) oleates and stearates. U.S. Pat. No. 3,907,134 employs a mixture of soap and starch for stabilization of coal-oil slurries. In our experience, however, such approaches to the problem are not entirely satisfactory and more effective means for stabilization of coal-oil slurries is required.

We have now found that coal oil slurries can be effectively stabilized against settling of the coal particles by incorporation in the slurry a mixture of a hydrogenated coal liquid and a grease made from an aluminum complex soap.

The coal liquid useful in the invention may be any of the numerous products derived from coal by load liquefaction processes which involve hydrogenation of which examples are the products of the COED, TOSCOAL or Garrett processes, the direct hydrogenation type of process exemplified by H-COAL, and SYNTHOIL processes, the solvent refining type exemplified by PAMCO and CONSOL processes, or of the syngas/Fisher-Tropsch type exemplified by the SYNTHOL process. Other liquid hydrogenated coal products are also useful.

Aluminum complex soaps (also known as aluminum di-soaps) and the greases made from them are well known in the art and are disclosed, for example, in U.S. Pat. No. 2,768,138 which is hereby incorporated by reference. These materials are typified by an aluminum-benzoate-stearate complex which is preferred for use in this invention.

In carrying out the invention the hydrogenated liquid coal product and the grease made from the aluminum complex soap are simply added to the coal-oil slurry. The grease used will be obtained by incorporating about 0.25% by weight of a 1:1 aluminum benzoate-aluminum stearate complex in an oil, as described in U.S. Pat. No. 2,768,138. The amount of grease and coal liquid together which is added to the coal-oil slurry will be from about 3.5% to about 10% by weight of the slurry, preferably about 5% to about 6%, of which the coal liquid will be from about 60% to 90% by weight (preferably 80 to 85%). A typical composition will comprise a slurry if 20 parts by weight of coal in 30 parts of Bunker C oil to which 2.5 parts of coal liquid and 0.5 parts of the grease are added.

Preferably the coal liquid and complex grease are added to a heated slurry of the particulate coal in the oil carrier. The resultant slurry is easily handled and is readily pumped through a pipeline and into appropriate burner nozzles for use.

The process of the invention is operable with generally all types of coal and the coal particle size may also vary. In general, however, the best results are obtained when the particle size of the coal is in the micron range and generally the coal will be below about 100 microns.

In order to further illustrate the invention the following examples are given:

Test Procedure:

Settling tubes are made with a transparent, flexible, plastic tubing (I.D. $\frac{3}{8}$") by plugging both ends of the tube with short lengths of glass rod (O.D. $\frac{3}{8}$"). Each tube is filled first with a $2\frac{1}{2}$" long segment of test slurry before closing off the tube. The test slurry is permitted to settle quiescently in a vertical position overnight in an oven at about 82° C. (about 180° F.). Upon removal from the oven, the sample is allowed to cool and is then chilled with dry ice enabling it to be sectioned into 5 segments each $\frac{1}{2}$" long and cut perpendicular to the direction of sedimentation. The sections are numbered respectively from the bottom section to the top as sections one through five. The tubing is removed from around each segment and the segments are then weighed twice in a wire mesh basket once in air and once in water after permitting the segment to warm to room temperature. The segment's density permits calculation of the percent coal based on the following quantities either measured or calculated:

1. the density of the oil in which the coal is suspended,
2. the density of the uniformly blended coal in oil slurry, and
3. the calculated effective coal density in the slurry.

The coal concentration of each section, when compared with that of the other sections indicate whether or not settlement of the coal occurred. Thus, if all sections have essentially the same coal concentration, no settling occurred and the coal-oil slurry is stable. If however, the coal concentration increases from segment number 5 through segment number 1, it is clear that settlement has occurred.

EXAMPLE 1

Samples are prepared of a coal-oil slurry comprising a mixture of 40% by weight of the mixture of Illinois No. 6 coal (less than 74μ in particle size) in an oil having a density of 0.94 or less (Bunker C fuel oil is preferred) and the test materials are added with thorough mixing. Control samples with no additive and with the additives separately are also evaluated for comparative purposes. Data for these tests and the data obtained are shown in the following table:

TABLE I

| Coal Concentration In Each Section Expressed As % by wt. Rounded To The Nearest 4% | | | | | |
|---|---|---|---|---|---|
| Sample | 1 | 2 | 3 | 4 | (Top) 5 |
| A Coal-Oil Slurry Control | 64 | 52 | 36 | 20 | 4 |
| B Slurry with Liquid Hydrogenated Coal Alone (5% by wt.) | 64 | 60 | 56 | 44 | 4 |
| C Slurry with Aluminum benzoate-stearate (1:1) grease Alone (1% by wt.) | 72 | 60 | 56 | 36 | 16 |
| D Slurry with Liquid Hydrogenated Coal (5% by wt.) and | | | | | |

TABLE I-continued

| Sample | Coal Concentration In Each Section Expressed As % by wt. Rounded To The Nearest 4% 1 | 2 | 3 | 4 | (Top) 5 |
|---|---|---|---|---|---|
| Aluminum benzoate-stearate (1:1) grease (1% by wt.) | 44 | 40 | 40 | 44 | 32 |

It is evident from the above that only in the case of the mixture of the coal liquid and the grease does the concentration of slurried coal remain essentially constant in all of the sections. In the other samples coal concentration increases significantly from top section to bottom, thus showing that settling has occurred.

EXAMPLE II

Coal oil slurries are prepared by dissolving 2.5 g. of hydrogenated coal liquid in 25 g. of Tetralin at room temperature and 20 grams of Illinois No. 6 bituminous coal ($<74\mu$) are then added and the mixture agitated. Then, 30 g. of Bunker C oil (d=0.94) and 0.5 g. of the aluminum based comples soap (aluminum benzoate-aluminum stearate complex) are added, heated to 105° C. and mixed well. The Tetralin solvent is then stripped off by distillation.

Using the technique described above, stabilization effect were measured. Table II gives the results obtained and includes several comparative materials which are similar to the hydrogenated coal liquid, but which are ineffective.

TABLE II

| Sample | Coal Concentration In Each Section Expressed As % wt. Rounded To The Nearest 4% 1 | 2 | 3 | 4 | 5 |
|---|---|---|---|---|---|
| A Coal Oil Slurry Control | 64 | 52 | 48 | 20 | 0 |
| B Slurry with Liquefied Hydrogenated Coal Vacuum Bottoms and Complex soap | 40 | 44 | 44 | 40 | 44 |
| C Slurry with Hydrogenated Liquefied Coal Liquid (Hydrogenated Anthracene Oil) and Complex Soap (Note 1) | 48 | 44 | 48 | 44 | 8 |
| D Slurry with Coal Liquid Obtained by Dissolution of Hydrogenated Coal Liquid in Solvent and Complex (Note 1) Soap | 48 | 48 | 44 | 44 | 16 |

TABLE II-continued

| Sample | Coal Concentration In Each Section Expressed As % wt. Rounded To The Nearest 4% 1 | 2 | 3 | 4 | 5 |
|---|---|---|---|---|---|
| E Slurry with Liquefied Coal-Gas Oil (Not Hydrogenated) and Complex Soap (Note 1) | 64 | 58 | 52 | 16 | 12 |

Note 1:
Slurry prepared by adding hot 2.5 g. of coal liquid to 5 g. of Bunker C and 0.5 g. of complex grease, to which 20 g. of the coal is added and mixed to form a paste. Then 25 g. of Bunker C added, heated with agitation to 105° C. and stirred under nitrogen until cool, and vacuum applied to remove bubbles from the liquid.

As can be seen from Table II only the system of the invention (B, C, and D) gives an essentially uniformly level concentration under the test conditions. Where a simiar slurry using a non-hydrogenated coal liquid is used, the coal slurry is not as stable as with the system of the invention.

The invention claimed is:

1. A process for stabilizing a slurry of particulate coal in oil against settling which comprises adding a mixture of a hydrogenated coal liquid and an aluminum based complex soap, the total amount of coal liquid and complex soap being from about 3.5 to about 10% be weight of the coal slurry of which mixture the coal liquid is from about 60% to 90% by weight.

2. The process of claim 1 where the soap is an aluminum benzoate-aluminum stearate complex.

3. A process for stabilizing a slurry of particulate coal in oil against settling which comprises adding with agitation to said heated coal slurry a mixture of a hydrogenated coal liquid and an aluminum based complex soap, the total amount of coal liquid and complex soap being from about 3.5 to about 10% by weight of the coal slurry of which mixture the coal liquid is from about 60% to 90% by weight.

4. The process of claim 3 where the soap is an aluminum benzoate-aluminum stearate complex.

5. A coal oil slurry stabilized against settling comprising particulate coal having a particle size of less than 100 microns suspended in oil and, as a stabilizing agent a mixture of a coal-derived hydrogenated liquid and an aluminum-based complex soap, the total amount coal derived liquid and complex soap being present in an amount of from about 3.5% to about 10% by weight of the coal slurry of which mixture the coal liquid is from about 60% to about 90% by weight.

6. The coal oil slurry of claim 5 where the complex soap is an aluminum-benzoate-aluminum stearate complex.

* * * * *